US006186410B1

(12) United States Patent
Mercier et al.

(10) Patent No.: US 6,186,410 B1
(45) Date of Patent: Feb. 13, 2001

(54) LANCE FOR HEATING OR CERAMIC WELDING

(75) Inventors: Robert Mercier, Gosselies; Jean-Pierre Robert; Jean-Pierre Meynckens, both of Villers-Perwin, all of (BE)

(73) Assignee: Glaverbel, Brussels (BE)

( * ) Notice: Under 35 U.S.C. 154(b), the term of this patent shall be extended for 0 days.

(21) Appl. No.: 09/402,783

(22) PCT Filed: Apr. 2, 1998

(86) PCT No.: PCT/BE98/00045

§ 371 Date: Oct. 12, 1999

§ 102(e) Date: Oct. 12, 1999

(87) PCT Pub. No.: WO98/46367

PCT Pub. Date: Oct. 22, 1998

(30) Foreign Application Priority Data

Apr. 11, 1997 (GB) ..... 9707369

(51) Int. Cl.[7] ..... B05B 1/24
(52) U.S. Cl. ..... 239/79; 239/132.3; 239/422
(58) Field of Search ..... 239/132.3, 79, 239/419.3, 422, 424, 428

(56) References Cited

U.S. PATENT DOCUMENTS

| | | | | |
|---|---|---|---|---|
| 3,131,091 | * | 4/1964 | Jones | 239/79 |
| 4,363,443 | | 12/1982 | Huehne . | |
| 4,646,968 | * | 3/1987 | Sablatura | 239/79 |
| 4,858,538 | * | 8/1989 | Kuypers et al. | 239/132.3 |
| 4,958,767 | * | 9/1990 | Labrot et al. | 239/79 |
| 5,207,382 | * | 5/1993 | Simm et al. | 239/79 |

FOREIGN PATENT DOCUMENTS

| | | |
|---|---|---|
| 0 062 986 | 9/1985 | (EP) . |
| 1 330 894 | 9/1973 | (GB) . |
| 2 025 265 | 1/1980 | (GB) . |
| 2 170 191 | 7/1986 | (GB) . |
| 2 237 803 | 5/1991 | (GB) . |

* cited by examiner

*Primary Examiner*—Andres Kashnikow
*Assistant Examiner*—Dinh Q. Nguyen
(74) *Attorney, Agent, or Firm*—Venable; George H. Spencer; Ashley J. Wells

(57) ABSTRACT

Apparatus and process for one of flame treatment or ceramic welding, the apparatus including a single tubular lance having a tip end, a butt end, and a head portion with a central main bore provided at the tip end so that ceramic welding materials comprised of particulate material containing oxidizable particles and combustion-supporting carrier gas are introduced at the butt end, pass through the main bore and emerge at the tip end during ceramic welding; wherein the head portion further comprises at least one conduit to convey a mixture of a fuel gas and a combustion-supporting gas, each of the at least one conduit having an orifice at the tip end of the single tubular lance and being provided with a portion for introduction of fuel gas and a portion for introduction of combustion-supporting gas so that fuel gas and combustion-supporting gas introduced at the butt end combine in the at least one conduit and emerge to form a flame at the tip end of the at least one conduit during flame treatment, and wherein the head portion is formed in two parts including an inner block including the central main bore, the conduits for fuel gas and combustion-supporting gas, and respective outlet orifices of the central main bore and at least one conduit, and an outer block including supply passageways to the inner block from respective supply tubes for particulate material and combustion-supporting carrier gas and for fuel gas and combustion-supporting gas.

20 Claims, 2 Drawing Sheets

LANCE FOR HEATING OR CERAMIC WELDING

BACKGROUND OF THE INVENTION

1. Field of the Invention

This invention relates to lance apparatus employed for either heating purposes or for ceramic welding purposes, such as providing a heating flame or conveying sand or like solid particulate material in a combustion-supporting carrier gas. In particular the invention relates to the tip configuration of a lance used alternatively to provide a flame or to effect ceramic welding. The invention also covers a process using the said lance apparatus.

2. Description of the Related Art

In ceramic welding, a mixture of solid refractory particles and solid combustible fuel particles of a metal or semi-metal such as aluminium or silicon is projected in a carrier gas stream, typically of oxygen, against a surface. The fuel particles react with oxygen in a highly exothermic manner to form a refractory oxide, sufficient heat being released against the surface to melt at least the surface of the refractory particles and form a coherent refractory mass. Such "ceramic welding" is described in Glaverbel GB patent specifications 1,330,894 and 2,170,191.

Ceramic welding can be employed for forming a refractory article, for example, a block having a particular shape, but it is most widely used for forming coatings or for repairing bricks or walls constructed of refractory oxide materials. It is particularly useful for repairing or reinforcing existing refractory furnace structures, for example, furnace walls in glassmaking or coke ovens, especially since the repair can be effected while the furnace is in operation.

In order to reach the repair zone, which may be several meters away from the operator, the lances tend to be long and to have much ancillary equipment such as flexible supply lines for the gases and particulate material. They also typically include a water-cooled jacket, with associated supply lines for the cooling water. Thus the lances can be very heavy and cumbersome to manipulate, requiring in some instances the provision of special scaffolding and associated lifting equipment to put them into the operating position.

In effecting the repair it is commonly necessary to prepare the surface to be repaired, for example to remove loose or foreign material in order to provide a sound base to which the repair mass can adhere. In some instances the repair surface has been treated by introducing a comburent gas into the zone to be repaired to burn off unwanted deposits.

Lances for use in such purposes as cleaning are long established. EP-A-0069286 relates to a lance for flame spraying a metal refining vessel including a furnace bottom cleaning device which feeds oxygen to the required point of use. Burners are also known to clean refractory surfaces.

Given the refractory nature of the base it is desirable to employ an intense cleaning flame which can if necessary quickly melt part of the surface to be repaired, leaving a fresh surface on which to effect the repair. Particularly in the case of glassmaking furnaces, a vitreous phase may be present as a residue of molten glass, as an exuded bonding phase in the refractory material or as a result of deposition of refractory dust from the vitrifiable material mixture introduced into the glass melting tank. A vitreous phase is especially likely to be found in refractory blocks at or from the level of the molten glass line in a glassmaking furnace. These blocks are typically of high quality Zac refractories.

A conventional repair of damaged or worn refractory walls within a furnace such as a glass furnace by means of first a flame treatment of the wall surface followed by spraying a ceramic welding powder mixture tends to involve much manipulation of the burner and of the ceramic welding lance. The steps of removing the burner and inserting and directing the ceramic welding lance to the flame-treated area can be difficult and time-consuming. The resultant delays, which may typically be 20 to 60 minutes, are also long enough for a vitreous phase to begin to reappear on the wall surface. Moreover the hardening effect, which creates a refractory structure which exudes less, is lost.

GB patent specification 2237803 relates to a ceramic welding nozzle which has a central bore for weld material in a gaseous fluid, such as air, and combustion means adjacent to the nozzle outlet for the injection into the gaseous fluid of a combustible fluid, such as propane, butane or acetylene. The combustion means is primarily employed to assist the weld formation by heating the weld particles and the substrate refractory. The combustible fluid mixes with the gaseous fluid from the central bore and reacts with the oxygen therein to form a heating flame in the vicinity of the repair zone. The flame can be used simply for preheating the repair surface but the defined nozzle does not lend itself to the formation of an intense flame, the combustible fluid being introduced into a gaseous fluid from the single central bore and thus being dispersed over a relatively wide area. This system does not permit and does not envisage scouring of the surface prior to the repair.

It is an object of the present invention to provide a lance which has an inbuilt capability to deliver an intense flame independently of its function for ceramic welding or like purposes.

SUMMARY OF THE INVENTION

According to the invention there is provided apparatus for alternatively creating flame or effecting ceramic welding, which comprises a single tubular lance having a tip end and a butt end and having a head portion with a central main bore at the tip end, whereby ceramic welding materials comprising particulate material containing oxidisable particles and combustion-supporting carrier gas are introduced at the butt end, pass through the main bore and emerge at the tip, characterised in that the head portion (10+20) further comprises at least one conduit (28) to convey a mixture of a fuel gas and a combustion-supporting gas, each such conduit (28) having an orifice (29) at the tip of lance and being provided with a portion **(28*a*) for the introduction of fuel gas and a portion (28*b*) for the introduction of combustion-supporting gas, whereby fuel gas and combustion-supporting gas introduced at the butt end combine in the conduit (28) and emerge to form a flame at the tip end of the or each conduit (28) and emerge to form a flame at the tip end of the or each conduit (28) and in that the head portion is formed in two parts, an inner block (20) including the main bore (23) and the (28) for fuel gas and combustion-supporting gas and including the outlet orifices of the said bore and conduit(s) (29), and an outer block (10) including supply passageways to the inner block from respective supply tubes for particulate material and carrier gas (13) and for fuel gas and combustion-supporting gas (15, 16)**.

The invention also provides a process for alternatively creating flame or effecting ceramic welding, using a single tubular lance having a tip end and a butt end and having a head portion with a central main bore at the tip end, whereby ceramic welding materials comprising particulate material containing oxidisable particles and combustion-supporting carrier gas are introduced at the butt end pass through the main bore and emerge at the tip, characterised in that a mixture of a fuel gas and a combustion-supporting gas is conveyed through at least one conduit in the head portion other than the main bore, the head portion further comprises at least one conduit having an orifice at the tip of the lance, whereby fuel gas and combustion-supporting gas separately introduced at the butt end combine in the conduit and emerge to form a flame at the tip end of the or each conduit.

By separating the flame-forming gases from the main stream gases the invention provides homogeneous mixing of these gases in the optimum proportions for the required flame allows the flame formation to be fully independent of the ceramic welding function required for the stream through the main bore. Thus the flame can first be employed to clean or otherwise treat a target surface and secondly the main bore stream can be commenced immediately for its intended ceramic welding purpose. Problems of manipulating the lance or different lances between the two different purposes are thus eliminated and the second purpose can start before any loss of heat occurs from the target surface.

The invention is also well suited to the use of high flame temperature fuel gases in easily controlled proportions to obtain the desired flame intensity. Acetylene and acetylene mixtures such as tetrene™ are generally preferred since they allow flame temperatures well in excess of 2000° C. to be readily achieved. Other gases such as propane may also be suitable for particular applications. The combustion-supporting gas is preferably oxygen as such.

For most purposes it is preferred that the main bore is substantially aligned with the central axis of the head portion and that a plurality of conduits for fuel gas and combustion-supporting gas are disposed around the main bore. The conduits should preferably be evenly distributed around the main bore and they should preferably be sufficient in number to provide a continuous annular flame, thereby providing heat across the full area to be treated. For a ceramic welding lance of conventional size the number of conduits to achieve this is typically 12. The conduits should preferably be parallel to each other but may be slightly divergent from each other, for example at an angle of 2–3° from the head axis. The resulting outward alignment of the formed flame assists in moving any molten material away from the treatment area. The removal of such molten material is also facilitated by the use of an intense high pressure flame as permitted by the invention.

Each of the plurality of conduits for fuel gas and combustion-supporting gas is preferably a branched conduit, with two feed branches combining to form a single outlet. The feed branches are supplied separately with fuel gas and combustion-supporting gas from the butt end of the lance and the said gases combine within the head to emerge fully mixed at the outlet orifice.

The preferred internal diameter of the conduits at the tip end of the lance depends upon the chosen fuel gas. For high flame temperature gases the diameter is preferably in the range 1.5 to 3 mm. For acetylene and tetrene the diameter is typically in the range 1.5 to 2.5 mm and for propane is typically in the range 2.0 to 3.0 mm.

The preferred pressure of the fuel gas/combustion-supporting gas mixture is dependent on the burner configuration and upon the nature of the substrate to be treated. It is generally measured, and can be readily adjusted, at the respective supply cylinders for the fuel gas and combustion-supporting gas. Such adjustment also permits the choice of a pressure which keeps the flame attached to the lance tip. When using industrially pure oxygen as the combustion-supporting gas the regulated supply pressure from the cylinder is typically about 4.0 to 5.0 bar (0.4 to 0.5 MPa). The fuel gas is typically supplied at a lower pressure, for example about 2.0 to 2.5 bar (0.2 to 0.25 MPa) and at a lesser rate than the combustion-supporting gas, such that in a branched supply conduit as described above the combustion-supporting gas exerts an aspirating effect on the fuel gas at the point of mixing.

For industrial applications, the burner setting can conveniently be effected outside the treatment zone on a trial piece, for example on a sample of a refractory material to be cleaned and repaired. In this example the proper setting (and from this the proper temperature) is determined by when melting of the refractory surface is observed.

For convenience of construction the head portion of the lance is preferably formed in two parts: an inner block including the main bore and the conduits for fuel gas and combustion-supporting gas and including the outlet orifices of the said bore and conduits, and an outer block including supply passageways to the inner block from respective supply tubes for particulate material and carrier gas and for fuel gas and combustion-supporting gas.

In a preferred embodiment the inner block of the head portion is located and held in position by a combination of internal threads in at least part of the outer block and external threads on at least part of the inner block.

Conveniently a shaped annular groove is provided in the outer surface of the inner block so as to form in association with the adjacent inner surface of the outer block an annular distribution chamber for fuel gas. Similarly it is convenient to provide a shaped annular groove in the outer surface of the inner block so as to form in association with the adjacent inner surface of the outer block an annular distribution chamber for combustion-supporting gas.

The lance is provided with a supply tube for the suspension of particles in a carrier gas stream, a supply tube for fuel gas and a supply tube for combustion-supporting gas. These tubes are conveniently encircled within a protective tube. This protective tube is not essential for the invention but constitutes a useful protection against gas-water mixture, for example in the event of leaks due to the rupture of solder in the gas supply lines. The protective tube ensures the rigidity of the lance but with an increase in its weight.

For many applications the lance preferably includes an external cooling jacket through which a fluid coolant such as water can be passed. The jacket typically comprises two tubes coaxial with each other and with the lance and with an opening or openings between the tubes at the tip end enabling the supply of coolant from the butt end though the annular space between the lance and the inner jacket tube and return of the coolant through the annular space between the inner and outer jacket tubes.

Lances employed for ceramic welding and including the above-described embodiments have no special requirements for compositions and feedrates of powder and carrier gas, being fully usable with the normally employed types and volumes of feed materials.

A particular advantage of the process according to the invention is that after a flame formed by combustion of the fuel gas is applied to a surface to be treated to achieve a desired effect thereon the flame treatment can be stopped and immediately replaced by a stream of particles in a carrier gas stream directed to the surface to be treated. As a result of the use of the flame, the surface of a refractory substrate for repair is completely renewed and has the same quench structure as a new block of the same material. The ceramic weld mass applied immediately thereafter through the main bore is fully compatible with the refractory substrate and its adhesion to the substrate is especially strong.

BRIEF DESCRIPTION OF THE INVENTION

The invention is further described below with reference to the accompanying drawings, in which, FIG. 1 is a sectional view of the end portion of a lance according to the invention (the section being taken along line B—B of the following FIG. 2). The lance is of a type suitable for ceramic welding.

DESCRIPTION OF THE PREFERRED EMBODIMENTS

Figure 1:
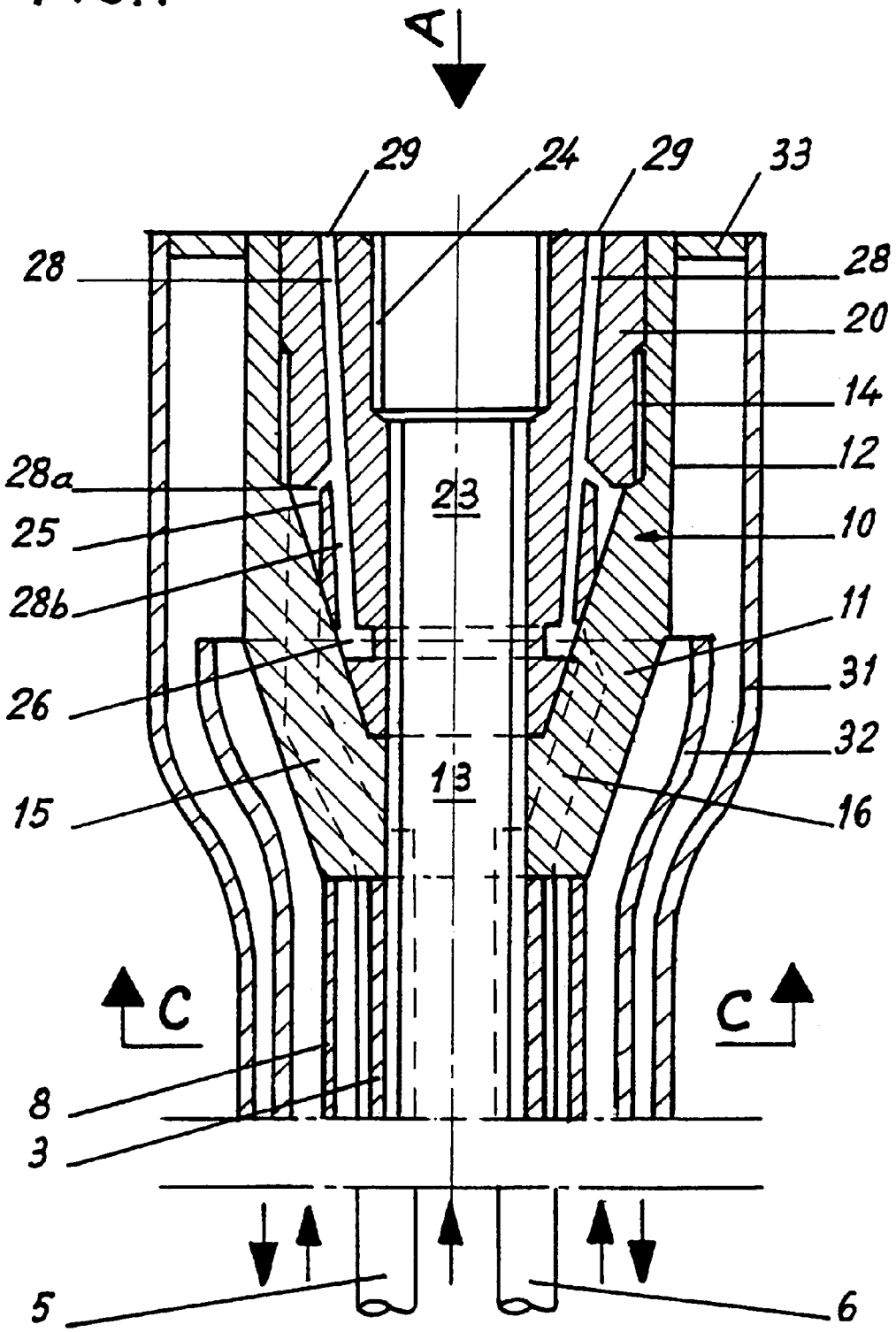
Figure 2:
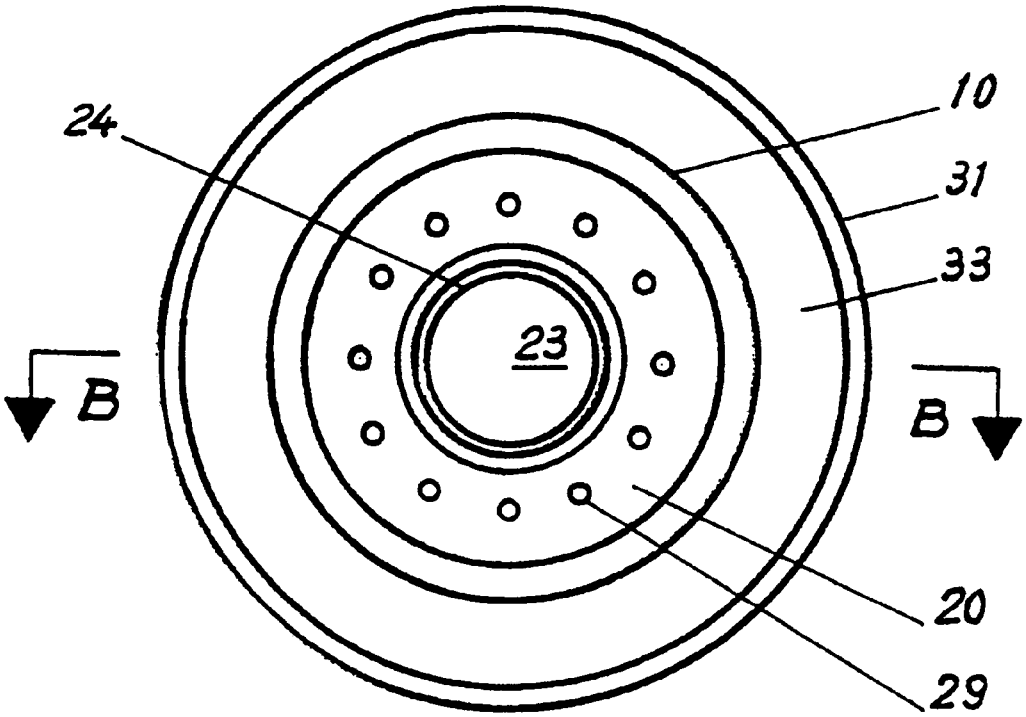
FIG. 2 is an end view of the tip of the lance shown in FIG. 1, the view being taken from position A—A on FIG. 1
Figure 3:
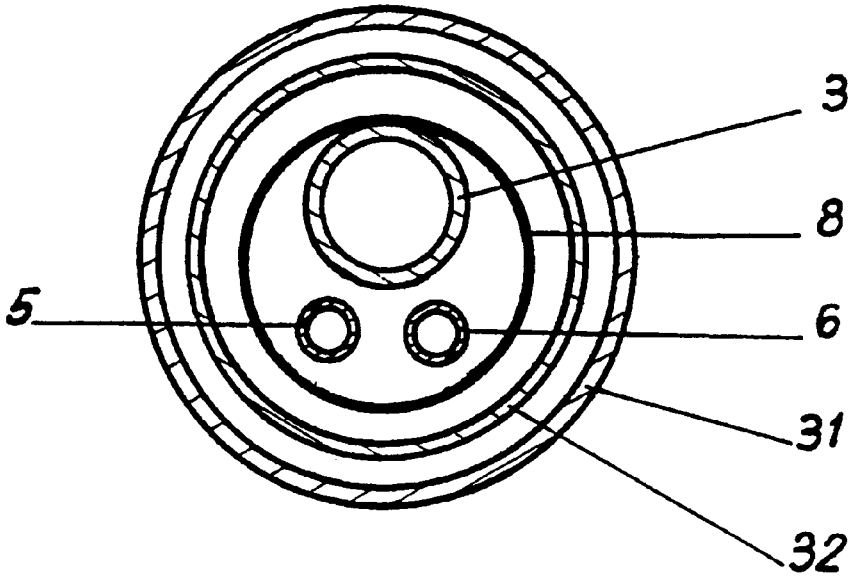
FIG. 3 is a sectional view of the end portion of the lance shown in FIGS. 1 and 2, the section being taken along line C—C of FIG. 2.

The illustrated lance has a supply tube 3 for a suspension of ceramic welding powder in a carrier gas stream, a supply tube 5 for fuel gas and a supply tube 6 for oxygen. A protective tube 8 encircles the tubes 3, 5 and 6. The powder suspension, fuel gas and oxygen are all conveyed in the direction indicated by the central arrow.

The tubes 3, 5, 6 and 8 are attached to and terminate in an outer hollow block 10 which has a generally frusto-conical portion 11 and a generally cylindrical portion 12. The block 10 has internal conduits 13, 15 and 16 which are shaped at its upstream end to be aligned with the ends of the tubes 3, 5 and 6 respectively and to provide conduits through the block 10 for powder/carrier gas, fuel gas and oxygen respectively.

An inner distributor block 20 is located within the outer hollow block 10, being held in place by complementary threads 14 on the respective blocks. The block 20 has an axial bore 23 aligned with the upstream end of the conduit 13 of block 10. At its downstream end the bore 23 includes internal threads 24 to receive an optional externally-threaded tubular insert to reduce the internal tip diameter of the bore 23 to the dimension best suited to the specific repair task. The said internal tip diameter is typically in the range 1.2 to 2 mm.

A shaped annular groove 25 in the outer surface of the block 20 forms in association with the adjacent inner surface of the block 10 an annular distribution chamber for fuel gas. The conduit 15 passes through the block 10 at an angle to its axis and terminates at its inner surface within the said annular distribution chamber.

Similarly a shaped annular groove 26 in the outer surface of the block 20 forms in association with the adjacent inner surface of the block 10 an annular distribution chamber for oxygen, the conduit 16 passing through the block 10 at an angle to its axis and terminating at its inner surface within the said chamber.

Branched bores (conduits) 28 of 2 mm internal diameter lead from the annular grooves 25 and 26 through the block 20, emerging at orifices 29 in its downstream face. The bores 28 comprise a long straight portion leading from the annular groove 26 to an orifice 29 and a short side branch 28*a* connecting from the annular groove 25. The portion of each bore 28 upstream of the side arm 28 is indicated by the reference number 28*b*. There are twelve such branched bores 28 and orifices 29 in the illustrated version.

In the primary intended use of the lance for ceramic welding repair operations, fuel gas and oxygen are initially introduced through tubes 5 and 6. The oxygen passes through angled conduit 16 to the annular groove 26 and then through the twelve bores 28 and orifices 29. The fuel gas passes through angled conduit 15 to the annular groove 25 and is drawn into the oxygen stream in the bores 28 through the side branches 28*a*. Thus the side branches 28*a* carry just fuel gas and the portions 28*b* carry just oxygen, such that the fuel gas and oxygen do not combine before they meet at the junction of branches 28*a* and portions 28*b*. A flame is created from the so-formed fuel gas/oxygen mixture emerging from each of the orifices 29, providing in combination a generally annular-shaped cleaning flame to be played on the surface to be repaired.

When the flame has had its desired effect on the repair surface the supplies of fuel gas and oxygen to tubes 5 and 6 are stopped. A stream of ceramic welding powder comprising refractory particles and solid fuel particles in an oxygen carrier gas stream is then introduced through the tube 3, conduit 13 and bore 23 to impinge upon the repair surface, where the solid fuel ignites to form a coherent and adherent repair mass.

A water jacket formed of an outer tube 31 and an inner tube 32 is disposed around the block 20 and tube 8. The ends of the tubes 31 and 32 are closed off by an annular end plate 33. In operation of the lance, cooling water is introduced in the direction shown by the two intermediate arrows in FIG. 1 into the annular space between the tubes 32 and 8, then through the annular end space between the tube 31 and block 10 and thence back out of the lance through the annular space between jacket tubes 31 and 32, as indicated by the outer arrows in FIG. 1.

In a trial employing apparatus as described above oxygen was supplied to the lance through the conduits 28 at a pressure of 4.5 bar (0.45 MPa) and propane fuel gas was supplied through the said conduits 28 at a pressure of 2.0 bar (0.2 MPa). The resulting flame was applied to AZS electrocast blocks to melt the surface and remove a surface layer, including a vitreous phase therefrom. The oxygen and propane supplies were then stopped and a ceramic welding powder suspended in oxygen as carrier gas was immediately supplied through the bore 23 to impinge on the refractory surface. A high quality adherent repair mass was formed on the refractory block.

What is claimed is:

1. Apparatus for one of flame treatment or ceramic welding, comprising:

a single tubular lance having a tip end, a butt end, and a head portion with a central main bore provided at the tip end so that ceramic welding materials comprised of particulate material containing oxidizable particles and combustion-supporting carrier gas are introduced at the butt end, pass through the main bore and emerge at the tip end during ceramic welding;

wherein the head portion further comprises at least one conduit to convey a mixture of a fuel gas and a combustion-supporting gas, each of the at least one conduit having an orifice at the tip end of the single tubular lance and being provided with a portion for introduction of fuel gas and a portion for introduction of combustion-supporting gas so that fuel gas and combustion-supporting gas introduced at the butt end combine in the at least one conduit and emerge to form a flame at the tip end of the at least one conduit during flame treatment, and wherein the head portion is formed in two parts, an inner block including the central main bore, the conduits for fuel gas and combustion-supporting gas, and respective outlet orifices of the central main bore and at least one conduit, and an outer block including supply passageways to the inner block from respective supply tubes for particulate material and combustion-supporting carrier gas and for fuel gas and combustion-supporting gas.

2. The apparatus as claimed in claim 1, wherein the head portion has a central axis, wherein the central main bore is substantially aligned with the central axis of the head portion, and wherein a plurality of conduits for fuel gas and combustion-supporting gas are disposed around the central main bore.

3. The apparatus as claimed in claim 2, wherein the plurality of conduits are evenly distributed around the central main bore.

4. The apparatus as claimed in claim 2, wherein the plurality of conduits are present in a number sufficient to provide a continuous annular flame.

5. The apparatus as claimed in claim 2, wherein each of the plurality of conduits is a branched conduit and wherein two branched conduits combining to form a single outlet.

6. The apparatus as claimed in claim 2, wherein each of the plurality of conduits has an internal diameter at the tip end of the single tubular lance which ranges from 1.5 to 3.0 mm.

7. The apparatus as claimed in claim 1, wherein at least a portion of the outer block is provided with internal threads, wherein at least a portion of the inner block is provided with external threads, and wherein the inner block is located and held in position by a combination of the internal threads provided in the outer block and the external threads provided on the inner block.

8. The apparatus as claimed in claim 1, wherein an annular distribution chamber for fuel gas is formed by a shaped annular groove provided in the outer surface of the inner block in association with an adjacent inner surface of the outer block.

9. The apparatus as claimed in claim 1, wherein an annular distribution chamber for combustion-supporting gas is formed by a shaped annular groove provided in the outer surface of the inner block in association with an adjacent inner surface of the outer block.

10. The apparatus as claimed in claim 1, wherein the single tubular lance further comprises an external cooling jacket through which a fluid coolant may be passed.

11. The apparatus as claimed in claim 10, wherein the fluid coolant is water.

12. Apparatus for one of flame treatment or ceramic welding, comprising:

a single tubular lance having a tip end, a butt end, and a head portion with a central main bore provided at the tip end so that ceramic welding materials comprised of particulate material containing oxidizable particles and combustion-supporting carrier gas are introduced at the butt end, pass through the main bore and emerge at the tip end during ceramic welding;

wherein the single tubular lance includes a supply tube for a suspension of particles in a carrier gas stream, a supply tube for fuel gas, and a supply tube for combustion-supporting-gas, and wherein a protective tube is provided which encircles the supply tubes in combination, wherein the head portion further comprises at least one conduit to convey a mixture of a fuel gas and a combustion-supporting gas, each of the at least one conduit having an orifice at the tip end of the single tubular lance and being provided with a portion for introduction of fuel gas and a portion for introduction of combustion-supporting gas so that fuel gas and combustion-supporting gas introduced at the butt end combine in the at least one conduit and emerge to form a flame at the tip end of the at least one conduit during flame treatment, and wherein the head portion is formed in two parts, an inner block including the central main bore, conduits for fuel gas and combustion-supporting gas, and respective outlet orifices of the central main bore and the at least one conduit, and an outer block including supply passageways to the inner block from respective supply tubes for particulate material and combustion-supporting carrier gas and for fuel gas and combustion-supporting gas.

13. A process for one of flame treatment or ceramic welding, comprising:

providing a single tubular lance having a tip end, a butt end, and a head portion, the head portion having a central main bore at the tip end, having at least one conduit having an orifice at the tip end, and being formed in two parts, an inner block including the central main bore, conduits for fuel gas and combustion-supporting gas, and respective outlet orifices of the central main bore and the at least one conduit, and an outer block including supply passageways to the inner block from respective supply tubes for particulate material and combustion-supporting carrier gas and for fuel gas and combustion-supporting gas;

introducing ceramic welding materials comprised of particulate material containing oxidizable particles and combustion-supporting carrier gas at the butt end of the single tubular lance, passing the ceramic welding materials and the combustion-supporting carrier gas through the central main bore and out at the tip end of the single tubular lance during ceramic welding; and conveying a mixture of a fuel gas and a combustion-supporting gas through the at least one conduit provided in the head portion other than the central main bore during flame treatment, wherein the fuel gas and the combustion-supporting gas are introduced separately at the butt end of the single tubular lance, are combined in the at least one conduit, and emerge from the tip end to form a flame during flame treatment but not when the ceramic welding materials are passed.

14. The process as claimed in claim 13, wherein the fuel gas is selected from the group consisting of propane, acetylene, and acetylene mixtures.

15. The process as claimed in claim 14, wherein the fuel gas is an acetylene mixture and is tetrene™.

16. The process as claimed in claim 13, wherein the combustion-supporting gas is oxygen.

17. The process as claimed in claim 13, wherein the fuel gas has a pressure ranging from about 2.0 to 2.5 bar (0.2 to 0.25 MPa).

18. The process as claimed in claim 13, wherein the combustion-supporting gas mixture has a pressure ranging from about 4.0 to 5.0 bar (0.4 to 0.5 MPa).

19. The process as claimed in claim 13, further comprising:

applying a flame formed by combustion of the fuel gas to a surface to be treated to achieve a desired effect thereon;

stopping the flame by halting the fuel gas supply; and immediately applying a stream of particles in a combustion-supporting carrier gas stream the surface to be treated.

20. The process as claimed in claim 13, wherein no ceramic welding materials are projected during flame treatment.

* * * * *